US008627856B2

(12) United States Patent
McHugh

(10) Patent No.: US 8,627,856 B2
(45) Date of Patent: Jan. 14, 2014

(54) CONTINUOUS GAS FILLING PROCESS AND APPARATUS FOR FABRICATION OF INSULATING GLASS UNITS

(75) Inventor: Michael Patrick McHugh, Solon, OH (US)

(73) Assignee: Integrated Automation Systems, LLC, Aurora, OH (US)

( * ) Notice: Subject to any disclaimer, the term of this patent is extended or adjusted under 35 U.S.C. 154(b) by 747 days.

(21) Appl. No.: 12/824,327

(22) Filed: Jun. 28, 2010

(65) Prior Publication Data

US 2011/0315270 A1 Dec. 29, 2011

(51) Int. Cl.
*B65B 1/04* (2006.01)
*B01F 13/10* (2006.01)

(52) U.S. Cl.
CPC ..... *B01F 13/1055* (2013.01)
USPC ..... 141/9; 141/61; 141/66; 141/104

(58) Field of Classification Search
USPC ..... 141/9, 61, 66, 103–105
See application file for complete search history.

(56) References Cited

U.S. PATENT DOCUMENTS

| | | | | | |
|---|---|---|---|---|---|
| 4,886,095 | A * | 12/1989 | Lisec | 141/4 |
| 4,921,022 | A * | 5/1990 | Lisec | 141/129 |
| 5,110,337 | A * | 5/1992 | Lisec | 65/58 |
| 5,350,469 | A * | 9/1994 | Lenhardt et al. | 156/102 |
| 5,366,574 | A | 11/1994 | Lenhardt et al. | 156/102 |
| 5,454,893 | A * | 10/1995 | Dietz | 156/104 |
| 5,573,618 | A | 11/1996 | Rueckheim | 156/104 |
| 5,676,736 | A * | 10/1997 | Crozel | 95/45 |
| 5,704,405 | A * | 1/1998 | Lisec | 141/196 |
| 5,735,318 | A * | 4/1998 | Vianello | 141/67 |
| 6,068,720 | A | 5/2000 | McHugh | 156/109 |
| 6,158,483 | A | 12/2000 | Trpkovski | 141/63 |
| 6,397,662 | B1 * | 6/2002 | Alkhoury | 73/31.04 |
| 6,622,456 | B2 * | 9/2003 | Almasy | 53/403 |
| 6,820,752 | B2 | 11/2004 | Jeskey et al. | 211/41.14 |
| 7,167,767 | B2 | 1/2007 | Clayton et al. | 700/100 |
| 7,184,146 | B2 * | 2/2007 | Trpkovski | 356/402 |
| 7,204,902 | B2 | 4/2007 | Wang et al. | 156/109 |
| 7,246,423 | B1 | 7/2007 | Holden et al. | 29/430 |
| 8,235,076 | B2 * | 8/2012 | Coignet et al. | 141/4 |
| 2003/0085238 | A1 * | 5/2003 | Segro | 222/3 |
| 2006/0043032 | A1 | 3/2006 | McHugh | 211/41.14 |
| 2013/0061978 | A1 * | 3/2013 | Donohue | 141/1 |

FOREIGN PATENT DOCUMENTS

| | | | |
|---|---|---|---|
| DE | 19513908 | 10/1996 | E06B 3/677 |
| DE | 9422004 | 1/1998 | E06B 3/673 |
| EP | 0 252 066 | 1/1988 | E06B 3/66 |
| EP | 0 276 647 | 8/1988 | E06B 3/66 |
| JP | 59-29884 | 2/1984 | F16K 31/06 |
| WO | WO 03/087516 | 10/2003 | E06B 3/66 |

OTHER PUBLICATIONS

IGAL™ advertising brochure, Air Liquide America Specialty Gases LLC, Jun. 2010.
International Search Report for International Application No. PCT/US2011/040538, dated Sep. 26, 2011.

* cited by examiner

*Primary Examiner* — Timothy L Maust
(74) *Attorney, Agent, or Firm* — Kusner & Jaffe

(57) ABSTRACT

A method and apparatus for filling insulating glass units with one or more insulating gases (e.g., Argon and Krypton gas). The insulating gases are supplied to gas filling tubes that are inserted into one or more interpane spaces of the insulating glass units. Each interpane space may be filled with more than one insulating gas. A control unit controls the injection of the insulating gases in accordance with gas filling data received by the control unit.

20 Claims, 7 Drawing Sheets

CONTINUOUS GAS FILLING PROCESS AND APPARATUS FOR FABRICATION OF INSULATING GLASS UNITS

FIELD OF THE INVENTION

The present invention relates generally to the fabrication of insulating glass units, and more particularly to a method and apparatus for filling insulating glass units with insulating gas.

BACKGROUND OF THE INVENTION

As window manufacturers continue to improve the thermal performance of their products in order to achieve higher efficiency and energy savings, the trend is to replace the air inside of insulating glass (IG) units with inert gases that are heavier than air, including, but not limited to, Argon (Ar), Krypton (Kr), or a blend thereof. Since Argon and Krypton both have a higher density than air, they function as insulating gases that increase the insulating value of an IG unit. Air has a density of about 1.29 grams/liter (@ STP). In contrast, Argon has a density of about 1.78 grams/liter (@ STP) and currently has a cost in the range of $0.02 per liter, while Krypton has a density of about 3.74 grams/liter (@ STP) and currently has a cost in the range of $1.00 per liter. Although Argon and Krypton will both improve the thermal performance of an IG unit, Argon is typically used to its maximum efficiency in wider air spaces (½" to ⅝"), and Krypton is typically used in narrower air spaces (¼" to ⅜").

Since both insulating gases, Argon and Krypton, are heavier than air, as the insulating gas fills the IG unit from the bottom thereof, the insulating gas pushes the lighter air gas to the top of the IG unit, and out of the enclosed air space of the IG unit. At some point in the filling process, there is a portion near the bottom of the IG unit that is mostly (above 90%) heavier than air gas (Argon, Krypton, or a mix of the two gases), and a portion near the top of the IG unit that is mostly air. Where the insulating gas interfaces with the air, there is a blended mixture of both air and the insulating gas. This blended mixture of gases is caused by convection, and dissipation of the insulating gas with the air it is replacing. For this reason, 150% to 500% of the injected insulating gas may be required to dilute the air volume in the IG unit down to less than 10% of what is remaining. A 90% fill rate has become an accepted standard in the IG fabrication industry.

The amount of time required to fill an IG unit with insulating gas (e.g., Argon, Krypton, or combination thereof) is affected by the following: (1) volume of air space in an IG unit; (2) flow rate of the injected insulating gas; (3) convection during the filling process (which is influenced by the flow rate); and (4) dissipation during the filling process (which is influenced by the time the gasses are exposed to each other).

To facilitate injection of a insulating gas into the space between glass panes (also known as "glass lites") of an IG unit, one or two openings or holes may be provided in the spacer that separates two adjacent glass panes. For IG units with spacers having a single hole, the hole is located at or near a corner of the IG unit. To inject insulating gas into the space between glass panes, the IG unit is typically positioned in a vertical orientation, with the hole positioned at, or near, the highest point of the IG unit. Existing "single hole" gas filling processes can take several different forms, including, but not limited to: (1) vacuum fill, (2) fast fill, and (3) slow fill (single hole) processes, which will now be described.

Vacuum fill: Vacuum filling happens when the entire IG unit (or multiple IG units) is inserted into a vacuum chamber. Over a period of time, most of the air is extracted from the space (i.e. "interpane" space) between glass panes (depending on desired fill rate), and then replaced by the desired insulating gas. Although this method is reliable, it is expensive to implement. In this respect, a vacuum chamber has fixed dimensions, and thus multiple vacuum chambers are needed to accommodate IG units of different sizes. If the vacuum chamber is too large for the TO unit, then a high percentage of insulating gas is wasted as it fills the space inside the vacuum chamber, but outside of the IG unit. The energy cost to operate a vacuum chamber is also high. For several of the above reasons, the vacuum fill method is not practical for fabrication of custom size IG units, or fabrication of standard size IG units in a just-in-time (HT) manufacturing environment.

Fast Fill: In order to minimize the fill time (resulting in reduced labor cost, as well as increased capacity) fast fill machines utilize a probe that is inserted into an IG unit and injects gas at a high rate (e.g., 6 to 10 liters per minute) from a first portion of the probe, while suctioning out exhaust gas at a second portion of the probe at substantially the same rate as the injection rate. This fast fill process not only causes convection, but encourages it. Since the gasses are mixed, the suctioned exhaust gas is passed through an oxygen sensor that monitors the concentration of oxygen therein. Since oxygen is roughly 115 of air (20.9%), the fast fill machine can be programmed to stop injecting gas when the oxygen concentration of the suctioned exhaust gas reaches a predetermined target concentration (e.g., approximately 0.9% oxygen, to achieve 90% insulating gas within the IG unit). The advantage of the fast fill process is that it reduces labor costs, increases capacity, and is suitable for both the fabrication of custom size IG units and the fabrication of standard size IG units in a just-in-time (JIT) manufacturing environment. A serious disadvantage of the fast fill process is that it wastes a significant amount of insulating gas (i.e., 200% to 500%). This waste of insulating gas makes the fast fill process impractical for injecting the relatively expensive Krypton gas.

Slow fill (single hole): The slow fill (single hole) process involves the insertion of a probe, or tube through a hole at the top of the IG unit, with the tube extending to the lowest portion of the IG unit. If the insulating gas is injected at a slow rate, convection is minimized, thereby reducing the amount of insulating gas that is wasted. This is beneficial where a relatively expensive insulating gas (such as Krypton) is being used. An advantage of the slow fill (single hole) process is the reduced insulating gas loss (typically 70% at an injection rate of 3 liters per minute, and less than 35% at an injection rate of 1 liter per minute). Disadvantages of the slow fill (single hole) process are higher labor costs, higher capital costs, and greatly reduced capacity due to the lengthened fill time.

To fill IG units with spacers having two holes or openings, the IG unit is typically positioned in a vertical orientation, with the first hole located proximate to the top of the IG unit and the second hole located proximate to the bottom of the IG unit. Existing "two holes" gas filling processes can take several different forms, including, but not limited to methods 1 and 2 described below.

Method 1: A first probe is inserted into the bottom hole of the IG unit for injection of the insulating gas. As discussed above, both Argon and Krypton are heavier than air, and thus injection of these gasses into the bottom of the IG unit minimizes the convection of these gasses with the air they are replacing. The injection rate of the insulating gas can be increased to minimize time, or reduced to minimize waste. A second probe is inserted into the top hole of the IG unit to suction exhaust gas from the IG unit. Injection of the insulating gas is stopped when the oxygen concentration of the suctioned exhaust gas reaches a target concentration.

Method 2: In this method, only one probe is used. The probe is inserted into the bottom hole of the IG unit. Since the insulating gas is heavier than air, it will displace air with predictable convection and dissipation, at different flow rates. This process uses a timer that is set based upon the flow rate, convection, dissipation, and predictable waste. This method is suitable when Argon is the insulating gas, since an intentional overfill is not costly. However, when an expensive insulating gas (such as Krypton) is used, this method requires a balancing between waste of the expensive insulating gas and the need to fill the IG unit to a prescribed minimum level.

The present invention provides a method and apparatus for filling insulating glass units with insulating gas that overcomes drawbacks of the prior art, and provides additional advantages.

SUMMARY OF THE INVENTION

In accordance with the present invention, there is provided a method for filling one or more insulating glass units with at least one insulating gas, each of said insulating glass units having at least one interpane space defined by adjacent glass panes separated by a spacer, said method comprising: inserting respective gas filling tubes into each said interpane space of the one or more insulating glass units; providing a control unit with gas filling data for determining the amounts of said insulating gas(es) to fill each interpane space of said one or more insulating glass units; and using said control unit to control the flow of insulating gas(es) to the gas filling tubes, wherein said flow of insulating gas(es) is controlled by the control unit to provide the amount of said insulating gas(es) according to the gas filling data; removing the respective gas filling tubes from each said interpane space after each said interpane space has been filled with insulating gas(es) according to the gas filling data; and sealing each said interpane space of said one or more insulating glass units.

In accordance with another aspect of the present invention, there is provided an apparatus for filling one or more insulating glass units with at least one insulating gas, each of said insulating glass units having at least one interpane space defined by adjacent glass panes separated by a spacer, said apparatus comprising: a holding rack having a plurality of holding locations for holding a respective insulating glass unit; one or more sources of insulating gases; a plurality of gas filling tubes fluidly connectable with said one or more sources of insulating gases, one or more gas filling tubes are associated with each holding location; and a control unit programmed to supply the plurality of gas filling tubes with amounts of the insulating gas(es) to fill each of the interpane spaces of the insulating glass units, said control unit using gas filling data to determine the amount of the insulating gas(es) to fill each of the interpane spaces of the insulating glass units.

An advantage of the present invention is the provision of a method and apparatus for filling insulating glass units with gas that improves the efficiency of the insulating glass unit fabrication process.

Another advantage of the present invention is the provision of a method and apparatus for filling insulating glass units that allows for reduced waste of insulating gases, thereby reducing costs for fabrication of insulating glass units.

Still another advantage of the present invention is the provision of a method and apparatus for filling insulating glass units that decreases the total time needed to fabricate insulating glass units by providing a continuous process flow integrated with IG production.

Still another advantage of the present invention is the provision of a method and apparatus for filling insulating glass units that allows for reductions in labor needed to fill insulating glass units with insulating gas.

Still another advantage of the present invention is the provision of a method and apparatus for filling insulating glass units that allows for increased automation and capacity of the gas filling process.

Still another advantage of the present invention is the provision of a method and apparatus for filling insulating glass units that allows for improvements in the monitoring and verification of the gas filling process.

Still another advantage of the present invention is the provision of a method and apparatus for filling insulating glass units that allows for efficient utilization of space needed for fabrication of insulating glass units.

Yet another advantage of the present invention is the provision of a method and apparatus for filling insulating glass units that allows simultaneous filling of multiple air spaces of an insulating glass unit.

Yet another advantage of the present invention is the provision of a method and apparatus for filling insulating glass units that is adaptable for both manual and automated manufacturing processes.

These and other advantages will become apparent from the following description of a preferred embodiment taken together with the accompanying drawings and the appended claims.

BRIEF DESCRIPTION OF THE DRAWINGS

The invention may take physical form in certain parts and arrangement of parts, a preferred embodiment of which will be described in detail in the specification and illustrated in the accompanying drawings which form a part hereof, and wherein.

DETAILED DESCRIPTION OF THE INVENTION

Figure 1:
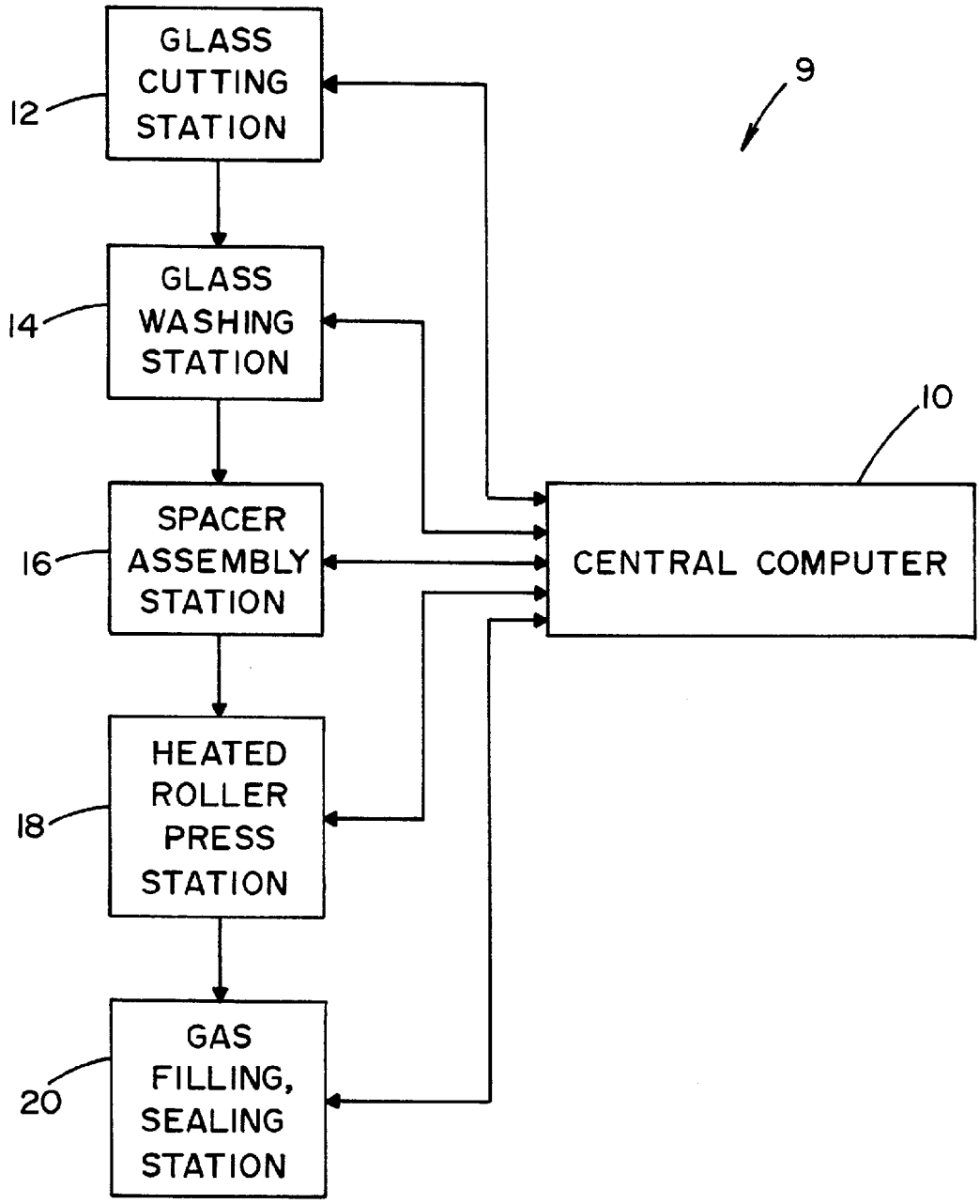
FIG. 1 is a block diagram illustrating a system for fabricating insulating glass units.

Referring now to the drawings wherein the showings are for the purposes of illustrating preferred embodiments of the invention only and not for the purposes of limiting same, FIG. 1 shows a system 9 used for fabrication of insulating glass units (IGUs). System 9 includes, but is not limited to, a central computer 10, a glass cutting station 12, a glass washing station 14, a spacer assembly station 16, a heated roller press station 18 and a gas filling and sealing station 20. It should be understood that system 9 illustrates one of many different systems that are known to those skilled in the art for use in the fabrication of IGUs. System 9 is shown for illustration purposes only and is not to be construed as limiting the present invention.

Central computer 10 is in communication with computers located at stations 12, 14, 16, 18 and 20, and may include a Plant Information System that has a scheduler for organizing production of IGUs. The scheduler is used to schedule IGU fabrication and keep track of the IGUs in various stages of fabrication. At each of the stations 12, 14, 16, 18 and 20, a computer monitor or other display unit (not shown) shows a section of the production schedule that includes the IGU currently being fabricated and several IGUs before and after the current IGU. Central computer 10 communicates via a wired or wireless network with computers located at one or more of the stations 12, 14, 16, 18 and 20.

Glass cutting station 12 operates in a known manner to optimize use of the glass, such that a maximum amount of each glass sheet is utilized. A glass cutter unit (not shown) produces a cutting map for a given sheet of glass and provides the cutting map or related information to central computer 10. Central computer 10 determines the breakout order of the pieces from the glass sheet and sets the order of IGU production accordingly.

A conveying system (not shown) may transport cut pieces of glass (referred to as glass panes or glass lites) to a glass washing station 14. Along the route of the conveying system, the glass panes are passed through an identification marking system (not shown), such as a device for attaching printed labels or applying a laser mark. The identification marking system marks each glass pane with one or more unit identifiers (e.g., a 2-D or data matrix bar code). The unit identifiers may provide information such as a serial number and/or a customer number. In conjunction with vision systems (e.g., bar code readers or scanners), the unit identifiers on the glass panes allows the glass panes and associated IGUs to be tracked throughout the IG fabrication process.

The washed glass panes are provided to a spacer assembly station 16. At the spacer assembly station 16, two or three glass panes are combined with appropriately sized spacers to respectively form an insulating glass assembly having one or two interpane spaces. The glass assembly is then provided to a heated roller press station 18, which seals the glass panes into an IGU. For asymmetric three pane IGUs, the two spacers have different dimensions such that the interpane space between the center pane and the first pane (e.g., ½ inch to ⅝ inch width) is larger than the interpane space between the center pane and the second pane (e.g., ¼ inch to ⅜ inch width). It should be understood that the present invention, as described below, is suitable for use in connection with the fabrication of IGUs comprised of two or more panes (e.g., dualpanes, tripanes, and quadpanes).

Figure 6:
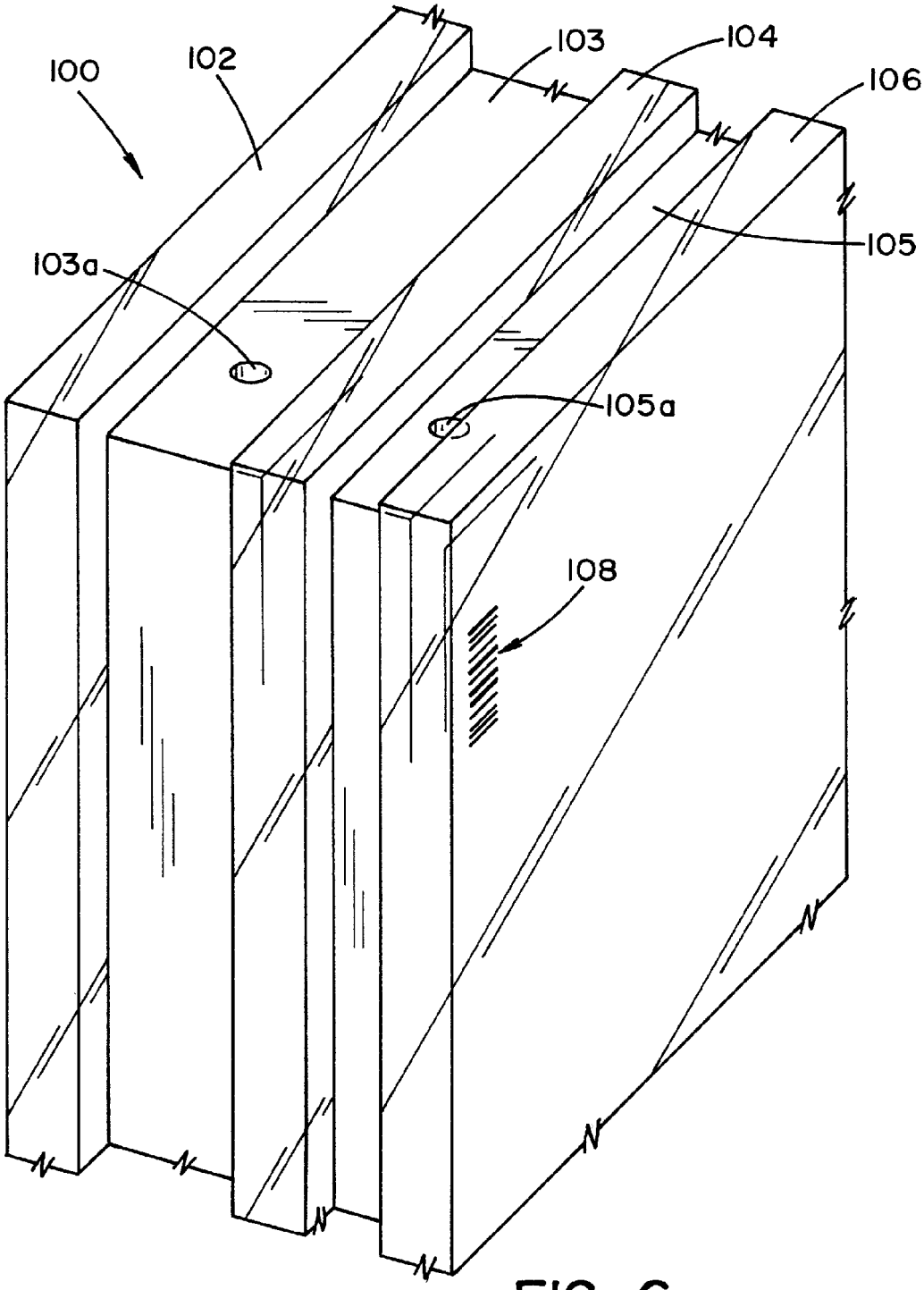
FIG. 6 is an enlarged perspective view of a portion of an insulating glass unit used in connection with the present invention.

FIG. 6 shows a three-pane IGU 100 comprised of a first pane 102, a center pane 104, and a second pane 106. A first spacer 103 is located between first pane 102 and center pane 104 to define a first interpane space, and a second spacer 105 is located between center pane 104 and second pane 106 to define a second interpane space. First and second spacers 103, 105 have respective holes 103*a*, 105*a* for injection of insulating gas into respective interpane spaces, as will be explained below. A unit identifier 108 is shown on second pane 106.

A conveying system (not shown) may transport the assembled IGUs to gas filling and sealing station 20 where air within each interpane space of the IGU is replaced with an insulating gas, such as Argon and/or Krypton, to improve the thermal properties of the IGU. The hole(s) or opening(s) in the spacers that provide access to the interpane spaces are closed after the IGU has been filled with insulating gas, thereby sealing the interpane spaces. The present invention is directed to an improved method and apparatus for carrying out the gas filling and sealing operations, and will be described in detail below.

Although the present invention is described with reference to fabrication of IGUs used in connection with windows, it is contemplated that IGUs fabricated using the methods and apparatus of the present invention may be used in connection with other types of fenestration system, including, but not limited to, doors, skylights or the like. Moreover, while the present invention is described herein with reference to Argon and Krypton gas to illustrate an embodiment of the present invention, it is recognized that other gases known to those skilled in the art may be substituted for air in the fabrication of IGUs (for example, xenon (Xe) and sulfur hexafluoride). Therefore, the present invention is not limited to use with only Argon and Krypton gas, but may be used in connection with other gases suitable for use with IGUs.

Figure 2:
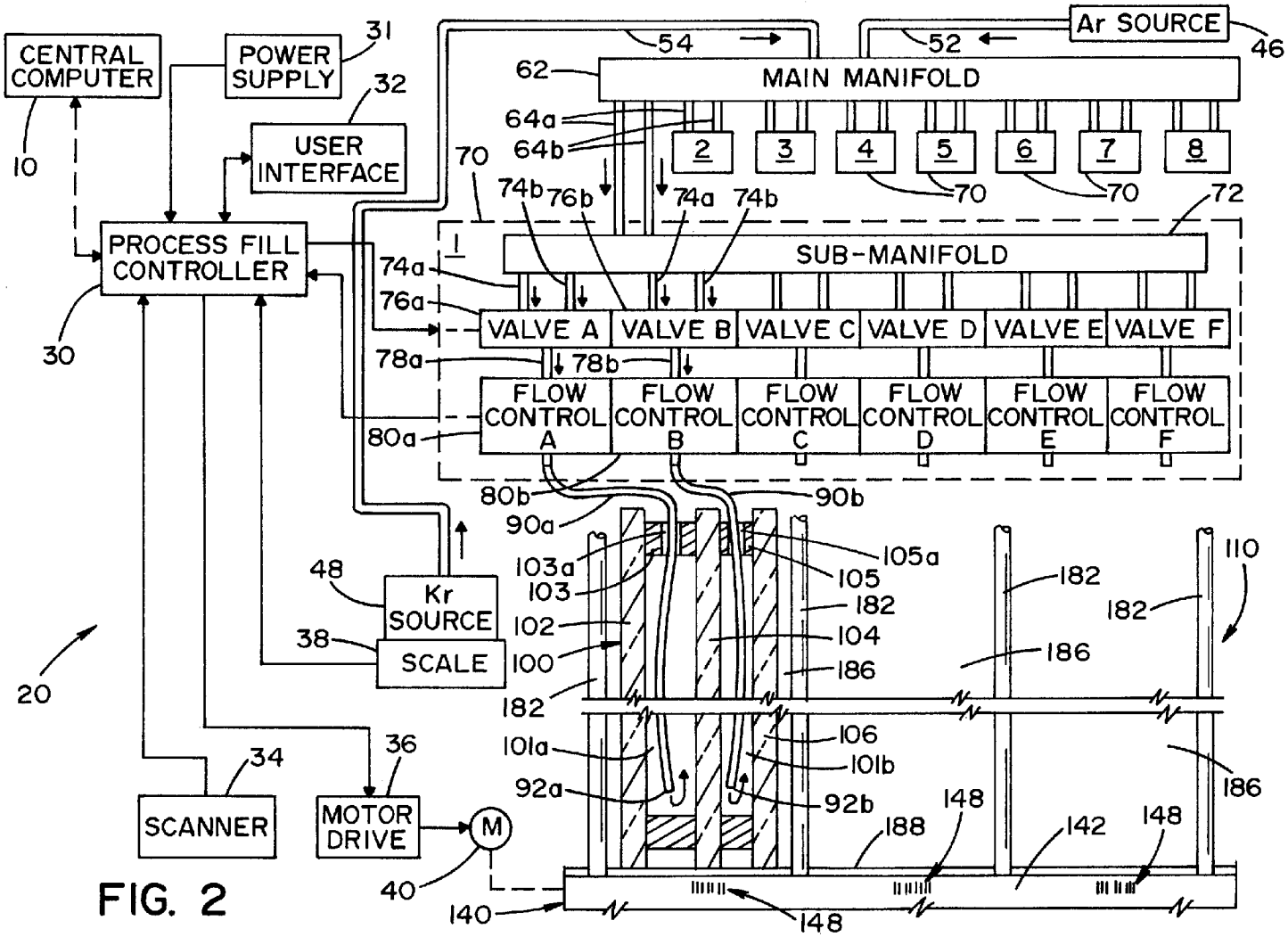
FIG. 2 is a schematic diagram illustrating components of a gas filling and sealing station according to an embodiment of the present invention.

Referring now to FIG. 2, there is shown a schematic representation of a gas filling and sealing station 20 according to an embodiment of the present invention. In the illustrated embodiment, station 20 includes a process fill controller 30, an Argon source 46, a Krypton source 48, a main manifold 62, a plurality of gas distribution systems 70 (units 1-8) and a support structure or assembly 110.

In the illustrated embodiment, Krypton source 48 is located on a conventional electronic scale 38 that monitors the weight of Krypton source 48, and communicates weight data to controller 30. Argon source 46 may be a source of Argon gas or liquid Argon that is vaporized to produce Argon gas. In the illustrated embodiment, Krypton source 48 with associated scale 38, main manifold 62, and gas distribution systems 70 are mounted to support assembly 110, as will be described below.

Process fill controller 30 is a control unit that communicates with components of station 20 that are described below. In the illustrated embodiment, control 30 is also in communication with central computer 10 (e.g., via a wireless communications link). Process fill controller 30 may take the form of a conventional programmable logic controller (PLC) or personal computer. Power supply 31 provides power to controller 30. A user interface 32 allows an operator at station 20 to communicate with controller 30. In this respect, user interface 32 may include input devices (e.g., keyboard, mouse, or touchscreen) and output devices (e.g, display monitor). A scanner 34 may also be connected with controller 30 to read encoded data (e.g., bar codes or the like) identifying IGUs, locations, and other data, as will be described in detail below.

Argon source 46 and Krypton source 48 are fluidly connected with main manifold 62 via respective input conduits 52 and 54. Main manifold 62 respectively distributes Argon and Krypton gas through a plurality of paired output conduits 64*a*, 64*b*. Each pair of output conduits 64*a*, 64*b* is in fluid connection with a respective gas distribution system 70. In the embodiment shown in FIG. 2, there are eight (8) individual gas distribution systems 70 (units 1-8). Only the first gas distribution system 70 (unit 1) is shown in detail in order to simplify illustration of the embodiment of the present invention.

Each gas distribution system 70 is comprised of a sub-manifold 72, a plurality of paired valves 76*a*, 76*b*, and a plurality of paired flow control units 80*a*, 80*b*. In the illustrated embodiment, each gas distribution system 70 has three (3) sets of paired valves 76*a*, 76*b* (identified as valves A-B, C-D and E-F) and three (3) sets of paired flow control units 80*a*, 80*b* (identified as flow control units A-B, C-D and E-F). Valves 76*a* and 76*b*, are fluidly connected with sub-manifold 72 via respective output conduits 74*a* and 74*b*. Valves 76*a*, 76*b* are controlled by controller 30 to select whether Argon or Krypton gas is supplied to flow control units 80*a*, 80*b* via input conduits 78*a*, 78*b*. Valves 76*a*, 76*b* are preferably solenoid valves.

Flow control unit 80*a* is fluidly connected with valve 76*a* via input conduit 78*a*. Likewise, flow control unit 80*b* is fluidly connected with valve 76*b* via input conduit 78*b*. Flow control units 80*a*, 80*b* are comprised of conventional flow control valves and flowmeters. The flow control valves regulate the flow or pressure of the Argon or Krypton gas according to signals received from controller 30, and respond to feedback signals generated by the flowmeters that are indicative of measured gas flow. Controller 30 transmits signals to the flow control valves to achieve a desired gas flow rate (e.g., 1 liter/minute).

Respective filling tubes 90*a* and 90*b* are fluidly connected to the outlets of flow control units 80*a* and 80*b*. Filling tubes 90*a*, 90*b* respectively include nozzles 92*a*, 92*b* at the distal ends thereof for dispensing gas.

It should be appreciated that the number of gas distribution systems 70 may vary depending upon the desired capacity. Likewise, the number of valves and flow control units comprising each gas distribution system 70 may vary depending upon the desired capacity. Moreover, it is also contemplated that in an alternative embodiment of the present invention, main manifold 62 may be modified to directly connect to valve pairs 76*a*, 76*b*, thereby eliminating the need for sub-manifold 72.

Figure 3:
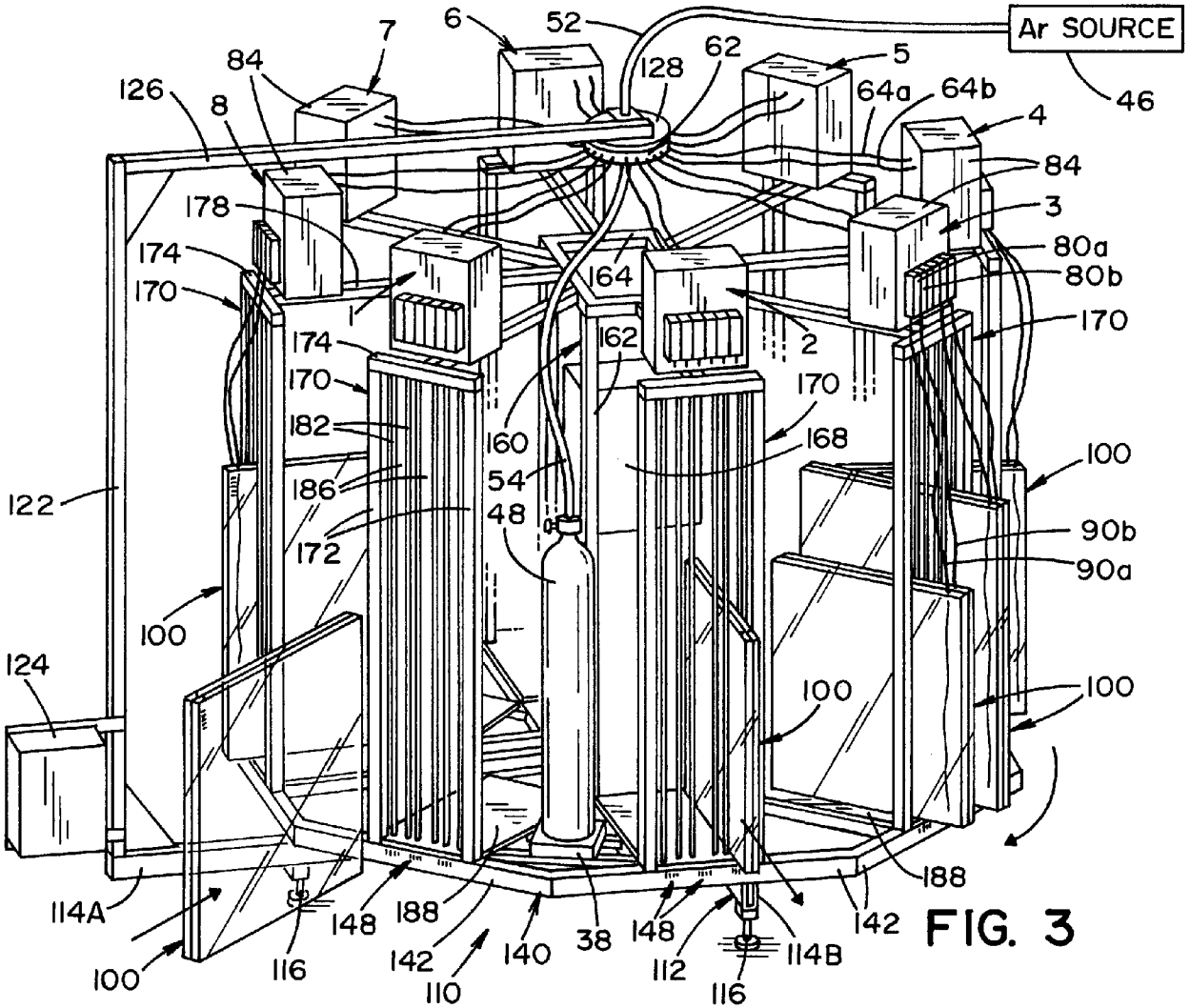
FIG. 3 is a perspective view of a support assembly of a gas filling and sealing station according to an embodiment of the present invention.
Figure 4:
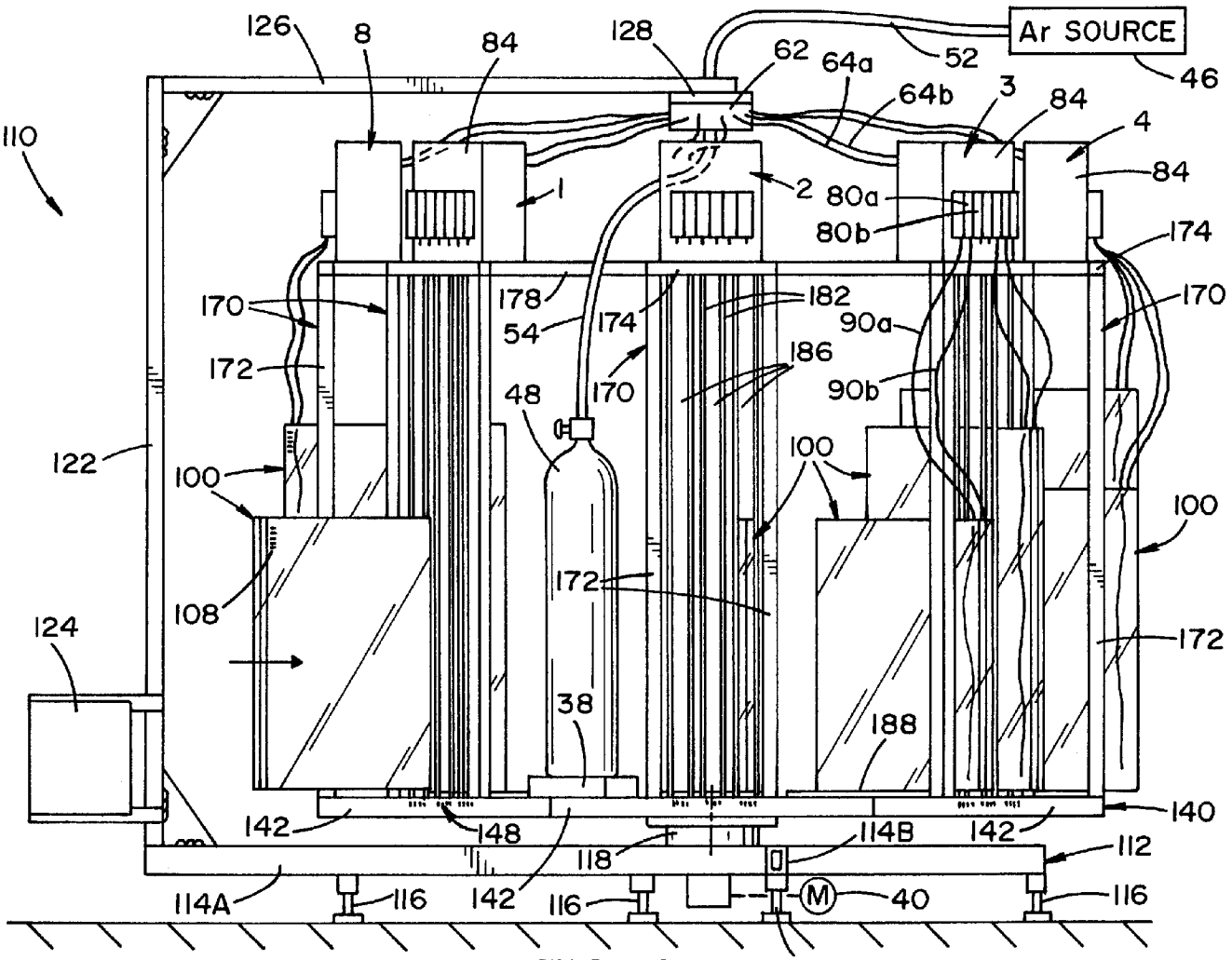
FIG. 4 is a front plan view of the support assembly shown in FIG. 3.
Figure 5:
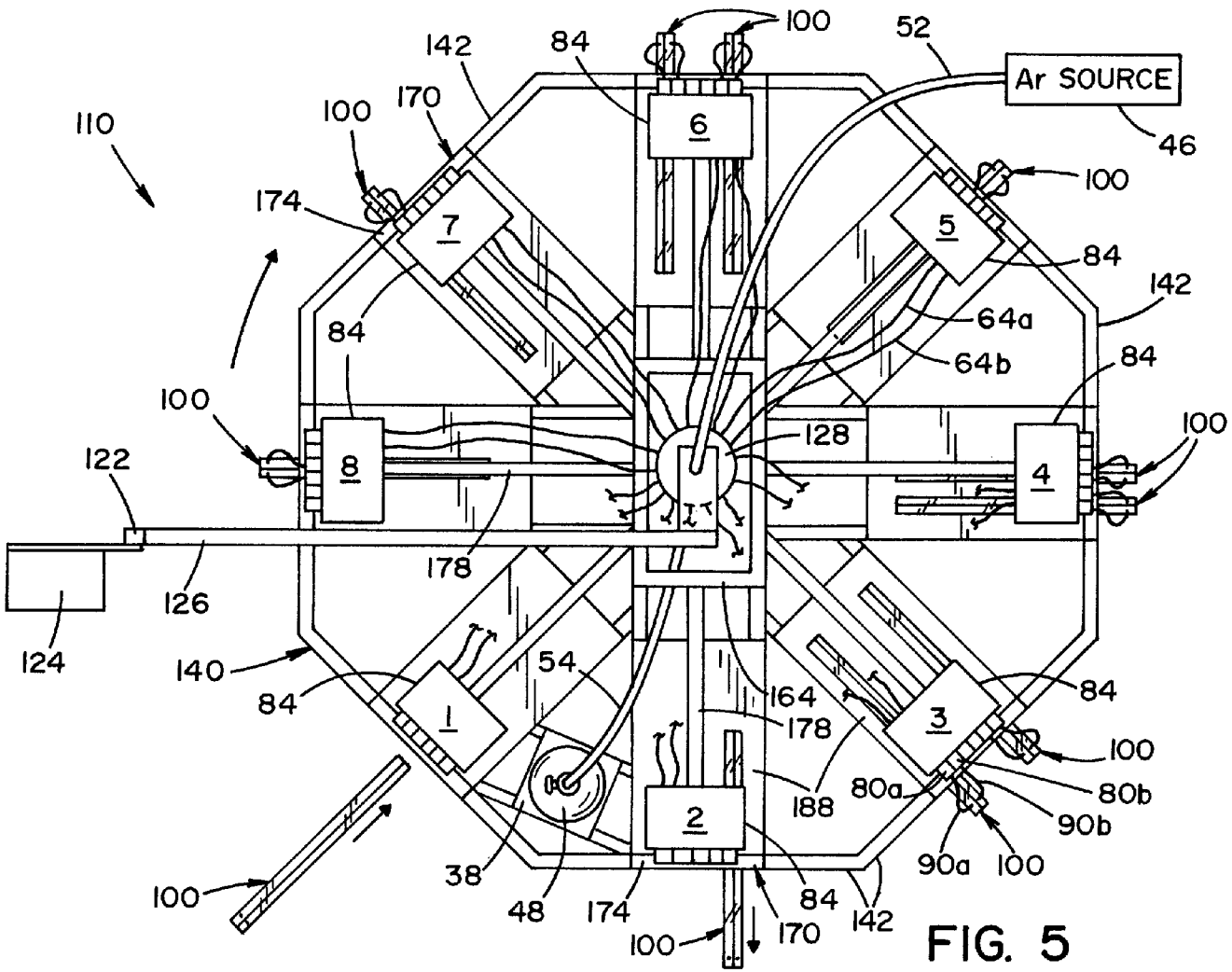
FIG. 5 is a top plan view of the support assembly shown in FIG. 3.

In the embodiment of the present invention shown in FIGS. 3-5, support assembly 110 is generally comprised of a stationary base 112, a rotatable turntable base 140, a center assembly 160 and a plurality of holding racks 170.

Stationary base 112 includes a pair of transverse cross-beams 114A, 114B, a vertical post 122 and a horizontal post 126. Height adjustable legs 116 extend from the lower portion of cross-beams 114A, 114B to adjust the height of stationary base 112 above a floor. Vertical post 122 extends upward from cross-beam 114A. A housing 124, containing power supply 31, is attached to vertical post 122 in the illustrated embodiment. Inward facing horizontal post 126 extends from the top end of vertical post 122. The free or distal end of horizontal post 126 is generally located above the center of stationary base 112. In the illustrated embodiment, main manifold 62 is mounted to the distal end of horizontal post 126. A rotational gas fitting 128 is located at the distal end of horizontal post 126 to receive input conduit 52 from remotely located Argon source 46. Argon source 46 may take the four of a cylinder containing Argon gas or liquid Argon that is vaporized to form gaseous Argon.

Turntable base 140 is mounted to stationary base 112 by a bearing 118, which allows turntable base 140 to rotate about an axis, relative to stationary base 112. In the illustrated embodiment, turntable base 140 includes a plurality of outer frame members 142 forming an octagonal-shaped frame.

A motor 40 rotates turntable base 140 via a transmission (not shown). For example, the transmission may be comprised of a gearbox, chain and sprocket. In one embodiment of the present invention, power is transmitted to turntable base 140 through a slip ring. Motor 40 is controlled by a motor drive 36 that is in communication with controller 30. Motor drive 36 may take the form of a variable frequency motor drive that allows turntable base 140 to be rotated at variable speeds. Controller 30 transmits signals to motor drive indicative of a desired rotation speed for turntable base 140. Power supply 31 provides power to motor 40 and motor drive 36.

In the illustrated embodiment, turntable base 140 also supports a Krypton source 48. Accordingly, Krypton source 48 rotates along with the turntable base 140. Krypton source 48 may be located on an electronic scale 38 that transmits weight data to controller 30. In the illustrated embodiment, Krypton source 48 takes the form of a gas cylinder. It should be appreciated that the Argon source 46 and/or Krypton source 48 may be located on turntable base 140.

Center assembly 160 is mounted to turntable base 140, and is comprised of a plurality of upward extending center posts 162 and an upper frame 164 located at the top end of center posts 162. A housing 168 may be mounted to center assembly for housing process fill controller 30.

A plurality of holding racks 170 are also mounted to turntable base 140. As illustrated, each holding rack 170 includes a floor panel 188, upward extending vertical frame members 172, a horizontal frame member 174, and a connecting arm 178 that extends between horizontal frame member 174 and upper frame 164 of center assembly 160. In the illustrated embodiment, a plurality of housings 84 are mounted to connecting arms 178. Each housing 84 houses a gas distribution system 70, which is described above. Each holding rack 170 also includes a plurality of vertical rods 182 that extend between horizontal frame member 174 and outer frame member 142. Vertical rods 182 and vertical frame members 172 define a plurality of slots 186 dimensioned to receive IGUs 100 for the gas filling operation. Accordingly, slots 186 serve as holding locations for the IGUs 100. Floor panel 188 provides a support surface for IGUs 100 that are inserted into slots 186. Each slot 186 has two associated filling tubes 90*a*, 90*b* for simultaneously filling the interpane space(s) of a two-pane IGU (one interpane space) or three-pane IGU (two interpane spaces). A location identifier 148 may be associated with each slot 186 to uniquely identify a holding location, i.e., the location of a specific slot 186 of holding rack 170. In the illustrated embodiment, location identifier 148 is provided on outer frame 142.

It should be appreciated that holding racks 170 may take alternative forms from those shown. Accordingly, the illustrated holding racks 170 are not to be construed as limiting the invention.

Wire conduits may be provided internal to the structural components comprising support assembly 110 in order to provide a convenient pathway for interconnecting wires between electrical and electronic components.

In the embodiment of the present invention illustrated in FIGS. 3-5, support assembly 110 is configured for a maximum capacity of twenty-four (24) IGUs 100. However, it is contemplated that the dimensions of support assembly 110 can be modified to increase or decrease maximum capacity.

A gas filling and sealing process according to an embodiment of the present invention, will now be described with reference to FIGS. 2-6. After assembling an IGU 100, the IGU 100 is transferred to gas filling and sealing station 20 (FIG. 1). It is contemplated that the same operator can place IGUs 100 onto support assembly 110 and insert gas filling tubes in IGUs 100, thereby minimizing the number of operators needed for the gas filling operation.

At station 20, an operator uses scanner 34 to scan unit identifier code 108 associated with IGU 100. The operator selects a slot 186 of a holding rack 170, and scans location identifier 148 associated with the selected slot 186. The operator then locates the IGU 100 in the selected slot 186. Accordingly, controller 30 is provided with data indicating the specific holding location of IGU 100 in support assembly 110.

Central computer 10 includes a database that may include, but is not limited to, one or more of the following items of gas filling data:

a. unit identifiers 108 for each IGU 100;
b. length, width, and interpane space(s) thickness of each IGU 100;
c. volume of the interpane space(s) of each IGU 100;
d. gas selection and gas fill sequence for each interpane space of each IGU 100 (e.g., Argon gas fill only, Krypton gas fill only, or Argon gas fill followed by Krypton gas fill);
e. volume of Argon and/or Krypton gas that is to used to fill the interpane space(s) of each IGU 100;
f. desired concentration of Argon and/or Krypton gas for the interpane space(s) of each IGU 100;
g. desired gas flow rate for Argon and/or Krypton gas; and
h. fill time of Argon and/or Krypton gas for the interpane space(s) of each IGU 100.

In the illustrated embodiment, central computer 10 provides controller 30 with the gas filling data necessary to fill the interpane space(s) of each IGU 100 with the desired amount of Argon and/or Krypton gas. For example, controller 30 transmits to control computer 10 the unit identifier 108 from the IGU 100 that is scanned using scanner 34. Central computer 10 then provides controller 30 with the following gas filling data for the IGU 100 corresponding to the received unit identifier 108: the length, width, and interpane spaces(s) thickness for IGU 100; gas selection and fill sequence for the interpane spaces(s) of IGU 100; and desired gas flow rate for each gas. Controller 30 uses the length, width and interpane space(s) thickness to determine the volume of the interpane space(s) of IGU 100, and uses the gas flow rate and determined volume to determine a gas fill time. Controller 30 uses a timer to determine when a gas filling operation is completed in accordance with the determined gas fill time.

Referring now to FIGS. 2, 3 and 6, the gas filling process will be described in detail for the IGU 100 located in slot 186 associated with gas distribution system 70 of unit 1 (FIG. 3). As described above, gas distribution system 70 includes a sub-manifold 72, valve 76*a* (Valve A), 76*b* (Valve B) and flow control units 80*a* (Flow Control A), 80*b* (Flow Control B). The operator inserts filling tube 90*a* through hole 103*a* (FIG. 6) to locate nozzle 92*a* proximate to the lower end of first interpane space 101*a*, as shown in FIG. 2. Likewise, the operator inserts filling tube 90*b* through hole 105*a* (FIG. 6) to locate nozzle 92*b* proximate to the lower end of second interpane space 101*b*, as shown in FIG. 2. In the illustrated embodiment, the diameters of holes 103*a*, 105*a* are larger than the diameters of filling tubes 90*a*, 90*b*. Accordingly, air displaced inside interpane spaces 101*a* and 101*b* escapes through holes 103*a*, 105*a*. It should be understood that spacers 103 and 105 of IGU 100 may have an additional hole for receiving a suction tube of a suction device (not shown) for removing air from interpane spaces 101*a* and 101*b*.

After filling tubes 90*a*, 90*b* have been inserted into respective interpane spaces 101*a*, 101*b*, the operator uses user interface 32 to instruct controller 30 to initiate gas filling. After IGU 100 has been loaded onto support assembly 110 and gas filling tubes 90*a*, 90*b* have been inserted into respective interpane spaces 101*a*, 101*b*, the attention of an operator is not required for gas filling. In this respect, gas filling data received by controller 30 indicates a desired gas selection and fill sequence for the interpane spaces of each IGU 100. Each interpane space may be filled with only Argon, only Krypton, or a combination of Argon and Krypton. When Argon and Krypton are used in combination, the interpane space is first filled with Argon ("pre-fill"), and then filled with Krypton ("post-fill"). In this regard, controller 30 transmits signals to valves 76*a*, 76*b* to fluidly connect flow controls 80*a*, 80*b* to the desired gas source 46 (Argon) and 48 (Krypton). In cases where an interpane space is to be filled with both Argon and Krypton gases, controller 30 transmits a signal to the valves 76*a*, 76*b* at an appropriate time to disconnect valves 76*a*, 76*b* from fluid connection with Argon source 46 and to fluidly connect valves 76*a*, 76*b* with Krypton source 48.

Controller 30 uses the unit identifier 108, location identifier 148 and gas filing data received from central computer 10 to operate valves 76*a* and 76*b* to select Argon or Krypton gas. Controller 30 regulates the flow of gas, according to the gas filling data, using the flow control valves and flowmeters of flow control units 80*a*, 80*b*. In this respect, controller 30 transmits signals to the flow control units 80*a*, 80*b* to achieve a desired gas flow rate (e.g., 1 liter/minute). As indicated above, controller 30 may include a timer for monitoring the fill time for the Argon or Krypton gas. For example, controller 30 may use the timer and the known gas flow rate (liter/minute) to determine when the proper volume of gas has been dispensed into the interpane spaces of IGU 100.

In order to determine or verify the concentration of gas within interpane spaces 101*a*, 101*b*, a conventional oxygen sensor (not shown) may be used to monitor the oxygen concentration of the air displaced from the interpane spaces of IGU 100 during the gas filling operation. The concentration of gas(es) within interpane spaces of IGU 100 may also be determined or verified by "sampling" the gas within the interpane spaces after completing the gas filling operation. In this respect, gas is sampled using a gas concentration sensing device, such as a thermal conductivity sensor (not shown), an optical gas sensing device, or other known gas sensor. A sampling operation may be initiated by controller 30 by periodically displaying instructions to the operator to take a sample of the gas of a specifically identified IGU 100.

In the illustrated embodiment, interpane spaces 101*a* and 101*b* are simultaneously filled with gas. Moreover, it is contemplated that when multiple IGUs 100 have been loaded onto support assembly 110, the respective interpane spaces of each IGU 100 may all be simultaneously filled with gas. In this manner, the interpane spaces of multiple IGUs 100 may be simultaneously filled with Argon and/or Krypton gas while the IGUs 100 are held within slots 186 and turntable base 140 rotates.

In one embodiment of the present invention, controller 30 operates motor drive 36 to continuously rotate turntable base 140 (e.g., at a rotation speed of approximately one (1) revolution per minute). It will be appreciated that the rotation speed of turntable base 140 may be varied to match a desired processing speed. In this regard, the rotation speed of turntable base 140 may be selected to match the speed of the IGU fabrication line.

After the gas filling operations are completed, gas filling tubes are removed from interpane spaces, and holes in the spacers are closed in a manner known to those skilled in the art to hermetically seal the interpane spaces. By rotating turntable base 140 during gas filling operations, the IGUs 100 are located proximate to an operator that removes the gas filling tubes from the interpane spaces at the completion of the gas filling operation. This same operator closes the holes in the spacers to seal the interpane spaces, removes the gas-filled IGU from support assembly 110, and loads the gas-filled IGU onto a holding rack (e.g., a conventional harp rack or the like) for further processing, storage or shipping.

As described above, in one embodiment of the present invention, the weight of Krypton source 48 is monitored by electronic scale 38. Electronic scale 38 transmits weight data to controller 30. This weight data can be used by controller 30 and/or central computer 10 to determine actual usage of the Krypton gas, determine yield losses, and to monitor for leaks. In this respect, measured consumption ($W_c$) of Krypton gas is determined by computing the difference between: (1) an initial weight (WO of the Krypton gas at Krypton source 38 and (2) the weight ($W_e$) of the Krypton gas at Krypton source 38 at the end of an operating shift (e.g., daily operations). The measured consumption ($W_c$) can also be compared to a theoretical consumption value to evaluate system efficiency or identify a system malfunction. Controller 30 may store the measured consumption ($W_c$) for several operating shifts to generate data reports.

An actual yield loss may be determined by comparing the measured consumption ($W_c$) of Krypton gas to the number of IGUs fabricated during an operating shift. Furthermore, gas leaks are determined by comparing the weight of the Krypton gas at Krypton source 38 at the end of a first time period (e.g., first operating shift) to the weight of the Krypton gas at Krypton source 38 at the beginning of a second time period (e.g., subsequent second operating shift).

It is further contemplated that controller 30 may store data indicative of the actual measured amount of gas inserted into a particular IGU. Such data may be used as a Statistical Process Control (SPC) quality program or as part of a certification program to assure customers that the IGU windows meet advertised thermal insulating values.

In the embodiment described above, unit identifiers 108 and location identifiers 148 are input into controller 30 in an automated process using scanner 34. However, it is also contemplated that unit identifiers 108 and location identifiers 148 may be input into controller 30 in a manual process. In this respect, an operator enters unit and location identification information into controller 30 using a keyboard or touchscreen. The unit identification information is provided to the operator on a printed schedule, or on a schedule displayed on a video monitor. The location information is provided to the operator from a printed label.

It is further contemplated that the present invention may be alternatively configured such that controller 30 (and associated components) operate as a "stand alone" system independent of central computer 10 (e.g., central computer 10 may be omitted). In this embodiment, the gas filling data stored in central computer 10 may be stored in controller 30. Alternatively, an operator may directly input gas filling data into controller 30 in a "manual" process. For example, for each IGU 100 an operator may directly input into controller 30 the length, width and interpane space(s) thickness; gas selection and fill sequence; and gas flow rate. As discussed above, controller 30 uses the foregoing gas filling data to determine interpane space volume and gas fill time. The operator may directly input the gas filling data into controller 30 by use of devices such as a touchscreen, keyboard, portable memory device (e.g., flash drive), bar code scanner, and the like.

Figure 7:
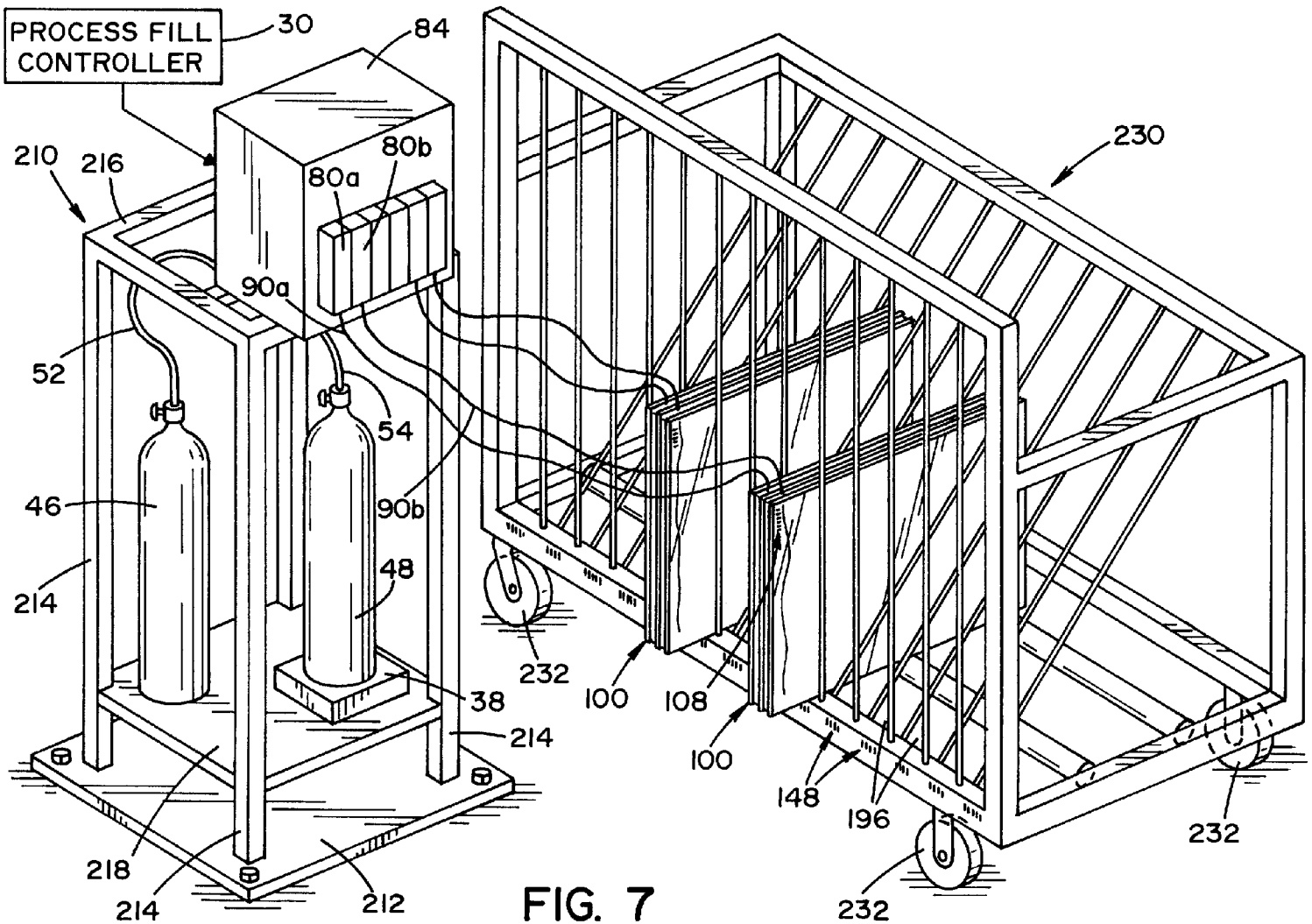
FIG. 7 is a perspective view of a gas filling and sealing station, according to an alternative embodiment of the present invention.

Referring now to FIG. 7, there is shown an alternative embodiment of the present invention. Components of this alternative embodiment that are similar to those of the embodiment described above have been given the same reference numbers. The alternative embodiment includes one or more stationary support assemblies 210. Support assembly 210 is generally comprised of a base 212, a plurality of vertical posts 214, an upper frame 216, and a generally planar shelf 218. Base 212 may be bolted to a floor. Housing 84, mounted to upper frame 216, houses a gas distribution system 70, as described above. Gas distribution system 70 is operably connected to controller 30 in the same manner as described above. It should be appreciated that more than one housing 84 may be mounted to upper frame 216 so that more that one gas distribution system 70 can be provided. This allows a large number of IGUs 100 to be filled with gas simultaneously.

Argon source 46 and Krypton source 48 are supported by shelf 218. As described in connection with the first embodiment of the present invention, Krypton source 48 may be located on an electronic scale 38 that provides weight data to controller 30. In the illustrated embodiment, Argon and Krypton sources 46, 48 take the form of gas cylinders. A holding rack, such as a conventional moveable harp rack 230, or the like, is used to hold IGUs 100 during the gas filling operation. Harp rack 230 includes a plurality of wheels 232 for conveniently moving harp rack 230 to a desired location. Harp rack 230 may also include location identifiers 148 that are associated with slots 196 that serve as holding locations. During the gas filling operation, harp rack 230 is moved proximate to support assembly 210. After the gas filling operations are completed, the gas filling tubes are removed from the interpane spaces, and the holes in the spacers are closed to hermetically seal the interpane spaces.

It should be appreciated that by using the automated controls described above, and eliminating filling tube changes during gas filling operations that use a combination of Argon and Krypton gases, the desired Krypton fill rate (to match traditional 90% krypton, and 10% air) can be achieved wasting 0% to 10% Krypton. Thus, the present invention can achieve significant reductions in both gas and labor costs.

Other modifications and alterations will occur to others upon their reading and understanding of the specification. It is intended that all such modifications and alterations be included insofar as they come within the scope of the invention as claimed or the equivalents thereof.

Having described the invention, the following is claimed:

1. A method for filling at least one interpane space of an insulating glass unit with at least two insulating gases, said method comprising:

providing a supply of a first insulating gas from a first source;

providing a supply of a second insulating gas from a second source;

obtaining gas filling data associated with a first interpane space of the insulating glass unit, said gas filling data indicative of the amount of the first and second insulating gases to fill the first interpane space;

filling the first interpane space with the first insulating gas in a first filling operation according to the gas filling data; and filling the first interpane space with the second insulating gas in a second filling operation according to the gas filling data, wherein the second filling operation occurs after completion of the first filling operation.

2. A method according to claim 1, wherein said method further comprises:

supplying the first and second insulating gases to the first interpane space via a first gas filling tube insertable into the first interpane space.

3. A method according to claim 1, wherein said gas filling data includes data indicative of the volume of the first interpane space.

4. A method according to claim 1, wherein said first insulating gas is Argon gas and said second insulating gas is Krypton gas.

5. A method according to claim 1, wherein said gas filling data includes one or more of the following:

a unit identifier identifying said insulating glass unit;

length, width, and thickness of the first interpane space of said insulating glass unit;

volume of the first interpane space;

selection of gases for the first and second insulating gases;

volume of the first and second insulating gases to fill the first interpane space;

desired concentrations for each of the first and second insulating gases within the first interpane space;

desired gas flow rates for each of the first and second insulating gases for filling the first interpane space; and fill times for each of the first and second insulating gases for filling the first interpane space.

6. A method according to claim 1, wherein said method further comprises:

obtaining gas filling data associated with a second interpane space of said insulating glass unit, said gas filling data indicative of the amount of the first and second insulating gases to fill the second interpane space;

filling the second interpane space with the first insulating gas in a third filling operation according to the gas filling data; and filling the second interpane space with the second insulating gas in a fourth filling operation according to the gas filling data, wherein the fourth filling operation occurs after completion of the third filling operation.

7. A method according to claim 6, wherein said first interpane space is filled with the first and second insulating gases simultaneously with filling of said second interpane space with the first and second insulating gases.

8. A method according to claim 7, wherein said first and second insulating gases are supplied to the first interpane space via a first gas filling tube insertable into the first interpane space, and said first and second insulating gases are supplied to the second interpane space via a second gas filling tube insertable into the second interpane space.

9. A method according to claim 1, wherein said first and second insulating gases are selected from the group consisting of the following: Argon, Krypton, Xenon, and sulfur hexafluoride.

10. A method according to claim 1, wherein said method further comprises:

monitoring volume of the first and second insulating gases flowing into the first interpane space to determine when to stop flow of the first and second insulating gases to the first interpane space.

11. A method according to claim 1, wherein said method further comprises:

providing a unit identifier associated with said insulating glass unit, said unit identifier used to obtain said gas filling data.

12. A method according to claim 1, wherein interpane spaces of a plurality of insulating glass units are simultaneously filled with said first and second insulating gases, each insulating glass unit have respective associated gas filling data.

13. A method according to claim 1, wherein said method further comprises:

monitoring weight of at least one of said first source for supplying the first insulating gas and said second source for supplying the second insulating gas, wherein changes in the weights of said first and second sources are indicative of the respective amounts of first and second insulating gases supplied by the first and second sources.

14. A method for filling at least one interpane space of an insulating glass unit with at least two insulating gases in a single gas filling operation, said method comprising:

supplying a first insulating gas from a first source;

supplying a second insulating gas from a second source;

providing a control unit with gas filling data for determining the respective amounts of each of said first and second insulating gases to fill a first interpane space of the insulating glass unit; and using said control unit to control flow of the first and second insulating gases into the first interpane space in sequential order, wherein the flow of each of said first and second insulating gases is controlled by the control unit to provide the respective amount of each of the first and second insulating gases according to the gas filling data.

15. A method according to claim 14, wherein said first and second insulating gases are respectively Argon gas and Krypton gas.

16. A method according to claim 14, wherein said method further comprises:

providing the control unit with gas filling data for determining the respective amounts of each of said first and second insulating gases to fill a second interpane space of said insulating glass unit; and using said control unit to control the flow of the first and second insulating gases into the second interpane space in sequential order, wherein the flow of each of said first and second insulating gases is controlled by the control unit to provide the respective amount of each of the first and second insulating gases according to the gas filling data.

17. A method according to claim 16, wherein said control unit simultaneously fills said first and second interpane spaces with said first and second insulating gases.

18. A method according to claim 14, wherein said control unit monitors the volume of the first and second insulating gases flowing into the first interpane space to determine when to stop the flow of the first and second insulating gases.

19. A method according to claim 14, wherein said method further comprises:

supplying the first and second insulating gases to the first interpane space via a first gas filling tube.

20. A method according to claim 14, wherein said first and second insulating gases are selected from the group consisting of the following: Argon, Krypton, Xenon, and sulfur hexafluoride.

* * * * *